United States Patent [19]

Ohno

[11] 4,145,900

[45] Mar. 27, 1979

[54] LOCK FOR FIRE DOORS

[75] Inventor: Richard J. Ohno, Branford, Conn.

[73] Assignee: Walter Kidde & Company, Inc., Clifton, N.J.

[21] Appl. No.: 853,248

[22] Filed: Nov. 21, 1977

[51] Int. Cl.[2] ..... E05F 15/20; E05C 19/00

[52] U.S. Cl. ..... 70/92; 292/92; 292/DIG. 66; 292/DIG. 65

[58] Field of Search ..... 292/92, DIG. 66, 166, 292/167, 169.21, DIG. 65; 70/92, 465; 49/1, 7, 8

[56] References Cited

U.S. PATENT DOCUMENTS

| | | | |
|---|---|---|---|
| 1,653,143 | 12/1927 | Zur | 292/167 |
| 2,536,295 | 1/1951 | Leonard | 292/167 X |
| 2,858,157 | 10/1958 | Eichacker | 292/92 |
| 3,097,007 | 7/1963 | Eichacker et al. | 70/92 X |
| 3,271,982 | 9/1966 | Welch | 70/92 |
| 3,324,692 | 6/1967 | Welch | 70/92 |
| 3,705,739 | 12/1972 | Adler | 292/DIG. 66 X |
| 3,811,717 | 5/1974 | Floyd | 292/92 |
| 4,003,593 | 1/1977 | Wilzig | 70/92 X |
| 4,007,954 | 2/1977 | Erickson | 292/92 X |

*Primary Examiner*—J. Franklin Foss
*Attorney, Agent, or Firm*—DeLio and Montgomery

[57] ABSTRACT

A surface mounted rim type lock set assembly for use on fire doors wherein a latch bolt is adapted for release by operation of a cross-bar on one side of the door and for release independently by manual operation of a lever-type handle on the other side, the assembly including a locking slide which is held out of engagement with the handle hub by heat responsive means adapted to release the slide when a portion of said means is melted. Normal locking and unlocking of the handle is effected by a key in a cylinder lock.

9 Claims, 9 Drawing Figures

LOCK FOR FIRE DOORS

The present invention relates to a rim type lock set assembly for use on fire doors and particularly to the lever handle control train in such an assembly.

Fire doors, as used in such buildings as hospitals, hotels, factories and stores, are commonly provided with exit devices in the form of horizontal bars which respond to pressure by releasing the latch bolt of the door to permit the escape of persons in an area threatened by fire, smoke or other emergency conditions. While escape is important, it is also desirable to provide means for keeping the door closed tightly, when not being used as an exit, in order to prevent the spreading of the fire or smoke. It has been found that heat may render the bolt spring ineffective and permit the weight of the bar and/or handle to effect retraction of the latch bolt, thus making the door freely openable. A type of lock set in which this problem is overcome is disclosed in Floyd & Erickson U.S. Pat. No. 3,811,717, May 21, 1974, and an improvement on that mechanism is disclosed in Erickson U.S. Pat. No. 4,007,954, Feb. 15, 1977. In each of these patents the lock set is of the mortise type, with the latch bolt projecting from the edge of the door, whereas the mechanism disclosed herein is of the rim type, having the latch bolt in a housing mounted on the inner surface of the door. The bolt can be actuated in the release direction by means of the bar, mounted on the same housing, and can also be released or locked by a mechanism in a second housing or case on the outer surface of the door, with which mechanism the present invention is primarily concerned.

It is an object of the present invention to provide a locking slide adapted for vertical movement into and out of engagement with a hub on the handle shaft, with a leaf spring arranged to hold the slide out of engagement with the hub but adapted to become ineffective upon the melting of a washer in the spring mounting, the relaxation of the spring permitting the slide to drop into hub-engaging position.

It is a further object of the invention to provide such mechanism wherein the latch can be actuated either by a handle or by a key in a cylinder lock.

It is another object of the invention to provide alternative forms of locking slides such that the key may be removed only when the slide is in locking position or may be removed regardless of the slide position.

It is a still further object to provide certain improvement in the form, construction and arrangement of the several parts whereby the above-named and other objects may effectively be attained.

The invention accordingly comprises an article of manufacture possessing the features, properties, and the relation of elements which will be exemplified in the article hereinafter described, and the scope of the invention will be indicated in the claims.

A practical embodiment of the invention is shown in the accompanying drawings, wherein.

Figure 1:
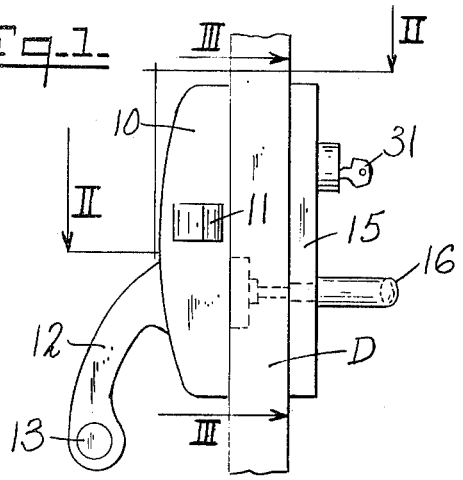
FIG. 1 represents an elevation of a door edge showing the relative position of the rim type latch assembly, with actuating cross-bar, and the lever-type handle mechanism assembly.
Figure 2:
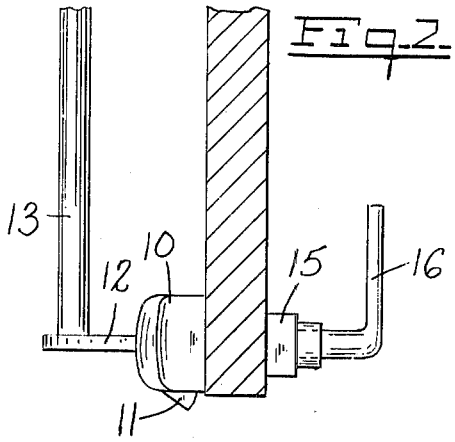
FIG. 2 represents a horizontal section on the line II—II of FIG. 1.

Referring to the drawings, and particularly FIGS. 1 and 2, a rim type latch housing is shown at 10, mounted on the inside surface of a door D, adjacent the edge thereof, with the latch bolt 11 protruding in a position to engage a strike (not shown) in the door frame. The mechanism in the housing 10 is adapted for actuation by movement of the lever 12, on which the cross-bar 13 is mounted, depression of the cross-bar causing retraction of the latch bolt in a conventional manner.

The latch bolt is operatively coupled to handle actuated mechanism (FIGS. 3 to 6) in a case 15 mounted on the outer surface of the door, the lever handle 16 being journaled in the casing at 14 and fitted on a spindle 17 which extends through the door and engages with latch bolt actuating mechanism in the housing 10, in a known manner, such that downward movement of the handle from its normal horizontal position will effect withdrawal of the latch bolt. When the latch bolt return spring is exposed to high heat, as during a fire, it may become ineffective and permit the lever handle to swing downward of its own weight, thus unlatching the door at a time when isolation of the fire is most needed. The mechanism disclosed herein prevents such unwanted operation.

On a squared portion 18 of the spindle 17 is fitted the locking hub 19, securely held by the lock nut 20, the hub being generally cylindrical but provided with upwardly projecting sectorial shaped ears 21, spaced by a radially disposed notch 22. The opposite edges of the ears are reduced in thickness, axially, and provided with pins 23, each adapted for engagement with one end of an arcuate link 24, the other end of which is engaged by the handle return spring 25. The same locking hub is adapted for either right-hand or left-hand operation depending on which pin 23 the link is mounted on. A stop screw 29 can be moved to either side (as to hole 29') according to the hand of the lock set.

The case is divided about midway of its height, and above the handle mounting, by a horizontal partition 26 provided medially with a notch 27. Above the partition the case has a horizontally projecting post 28. In its upper portion the case is bored to receive the lock cylinder 30, adapted for operation by a properly shaped key 31 to rotate the cam 32.

Figure 7:
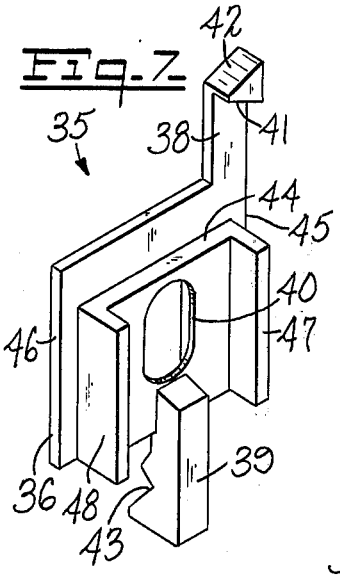
FIGS. 7 and 8 are detail orthogonal projections showing alternative forms of locking slides.

Locking and unlocking of the hub 19 is effected by means of the locking slide 35 which has a generally square body portion 36, a cut-away recess 37 in one face, an upwardly projecting post 38 at one upper corner, and a downwardly projecting arm 39 below the recess. The middle of the body portion is traversed by a vertically elongated slot 40, the upper end of the post is provided with downwardly and upwardly facing cam follower faces 41 and 42, respectively, and the arm 39 has its surface below the recess formed to provide a V-shaped notch 43. Below the faces 41, 42 the upper wall of the body portion 36 is cut away, as shown in FIG. 7, to leave a flat horizontal surface 44. The dimensions of the slide, as determined by the parallel side edges 45, 46 and the vertical ribs 47, 48 on the surface opposite the recess 37, are such as to permit loosely guided vertical movement of the slide within the case.

The slide is located in operative position by placing it in the case with the post 28 in the slot 40 and the arm 39 resting freely in the notch 27. A lead washer 50 is placed on the screw 51 which is then passed through a hole near the upper end of the leaf spring 52 and the screw is screwed into a threaded hole in the end of the post 28. The free end of the spring is formed with a projecting ridge 53, adapted to engage in the notch 43 when the slide is in its upper (unlocked) position (FIGS. 3 and 4).

The path of travel of the cam 32 is such that the cam engages one of the surfaces 41 or 42 in any position of the locking slide. With the parts in the positions shown in FIGS. 3 and 4 the latch bolt is under the control of the handle 16. When the handle is depressed the spindle 18 and locking hub 19 rotate counter-clockwise (FIG. 3) against the bias of the return spring 25 and the latch bolt is withdrawn for opening the door; when the handle is returned to its horizontal position, by spring 25 with or without manual assistance, the latch bolt is caused to project into latching position.

Figure 3:
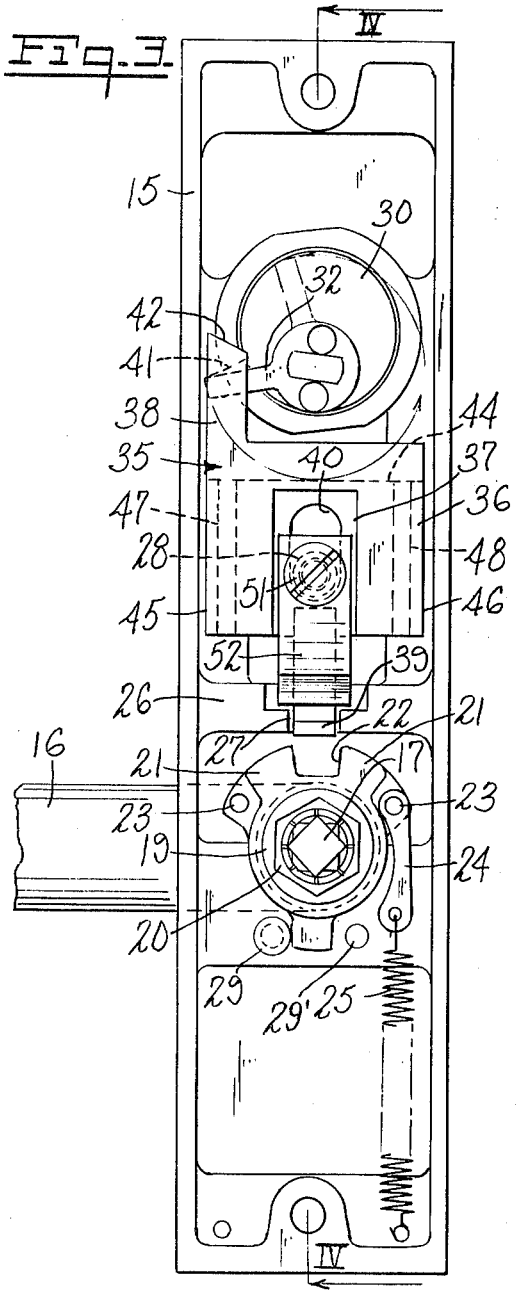
FIG. 3 represents a vertical section on the line III—III of FIG. 1.
Figure 4:
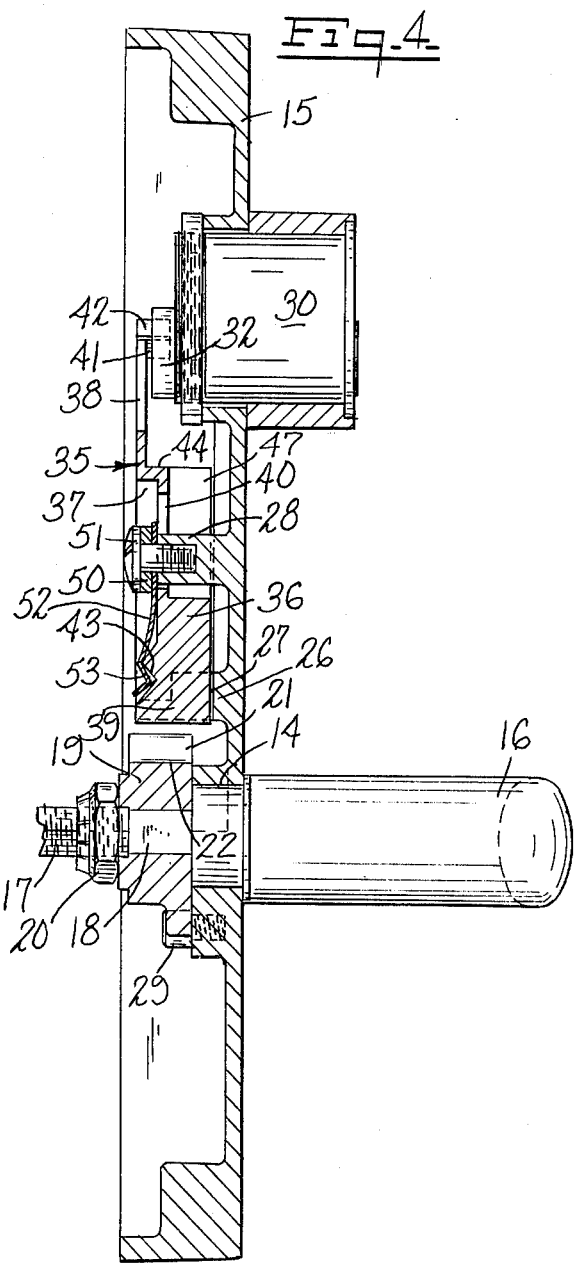
FIG. 4 represents a vertical section on the line IV—IV of FIG. 3.

To lock the door with a key, the key 31 in cylinder 30 is turned to rotate the cam 32 through about 360°, in the counter-clockwise direction as shown in FIG. 3, causing the end of the cam to press down on the surface 42 and thus move the locking slide downward. The notch 43 on arm 39 is freed from the ridge 53 on the flat spring 52 and the lower end of the arm is projected into the notch 22 in the locking hub 19, between the ears 21, effectively locking the hub against rotation in either direction. The surface 44 on the slide is in a position to be cleared by the cam at all times, so that the key may be returned to its removable position whether the door is locked or not.

Figure 5:
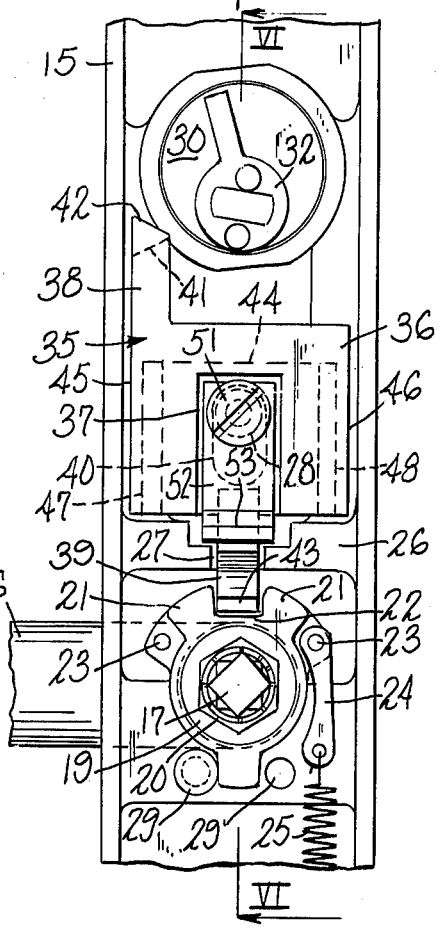
FIG. 5 is a detail view corresponding to FIG. 3 with the slide in locking position.
Figure 6:
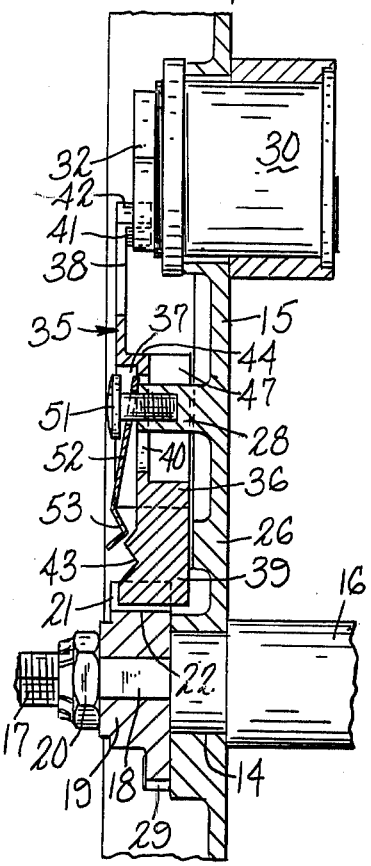
FIG. 6 represents a vertical section on the line VI—VI of FIG. 5.

When the door (assumed to be a "fire door") is exposed to heat, as from a fire, it becomes important to maintain the door in closed condition. At elevated temperatures the normal return springs, such as spring 25, lose their effectiveness and would permit the latch bolt to be retracted as the lever handle sags downward due to its weight. In the present mechanism, however, heat at or above 621° F. (327.25° C.) causes the lead washer 50 to melt, before the spring 25 becomes ineffective. Upon the disappearance of the washer, the tension of the flat spring is relaxed, as shown in FIG. 6, and the locking slide drops by gravity into its locking position (FIGS. 5 and 6). This movement is entirely independent of the position of the key and cam 32; the cam is shown, in FIG. 3, beneath the surface 41 but that is to illustrate the end of the unlocking movement and the cam could never be held in that position except manually.

Figure 8:
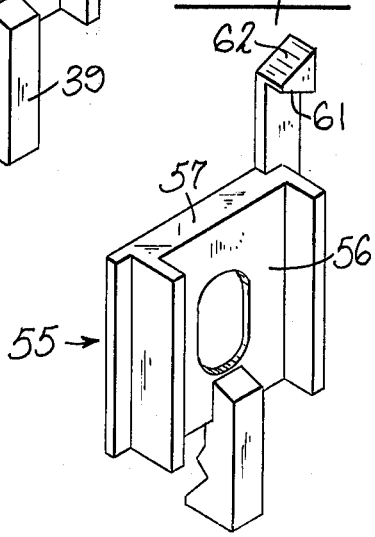
Figure 9:
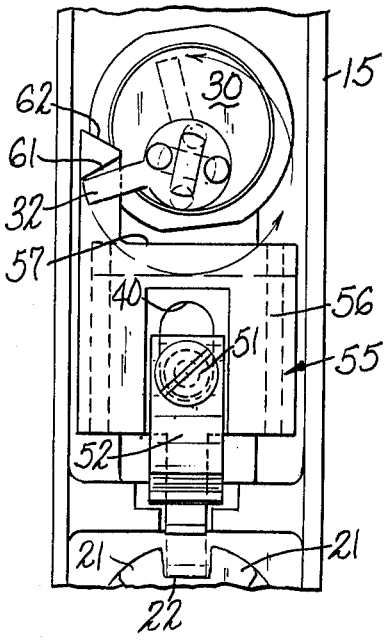
FIG. 9 represents a detail elevational view, similar to FIG. 3, showing the use of the slide shown in FIG. 8.

In the alternative form of locking slide 55, shown in FIG. 8, the upper portion of the slide body 56 is not cut away so that the flat horizontal surface 57, below the cam follower faces 61, 62, extends into the path of the cam 58 when the slide is in its upper, unlocked, position as shown in FIG. 9. The slide 55 is otherwise identical with the slide 35 and the lock mechanism in which it is used is the same as that shown in FIGS. 3 to 6. The different location of the surface 57, compared to surface 44, has the effect of compelling movement of the slide to its locking position before the key can be removed from the cylinder. Comparing FIG. 9 with FIG. 3, it is evident that movement of the cam 58 to a straight down position will push the slide downward, whereas cam 32 passes freely above the surface 44 without touching it, in either position of the slide 35.

It must be noted, in reference to the installation shown in FIGS. 1 and 2, that the cross-bar mechanism 10–13 on the interior surface of the door is provided with special steel return springs, capable of remaining operative even when subjected to high temperatures. The latch bolt can be operated from either side, independently, so that the immobilizing of the locking hub 19 and spindle 17, as previously described, to prevent accidental opening of the door in response to overheating, still leaves it available as an emergency exit upon actuation of the cross-bar ("panic bar"). If required or permitted by conditions during or after a fire, the lock described herein can be released by the use of a key in the cylinder, the cam being in a position to lift the slide from its locking position regardless of the circumstances that placed it there; this being in contrast to heat-actuated locking mechanisms which are not releasable, as in the patents cited above.

While the fusible washer 50 is referred to as being "lead", it could be fabricated from other materials with low melting points, such as certain plastics or metal alloys, to cover any desired temperature range.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What I claim is:

1. In a fire door lock set wherein a latch bolt is adapted for actuation by a spindle, a lever handle fixed on the spindle, a locking hub fixed on the spindle, a locking slide having a portion movable vertically into and out of engagement with said hub, key actuated means for moving the slide, resilient means for holding the slide in disengaged position and a heat responsive element operatively associated with said resilient means in a position to render the resilient means inoperative upon the melting of said element.

2. A lock set according to claim 1 which includes a case adapted for securement on the surface of a door, the case having at least three vertical walls, the lever handle being journaled in one wall, the slide being guided for vertical movement by at least two walls and the resilient means being mounted on one wall.

3. A lock set according to claim 2 wherein the resilient means is a leaf spring and the heat responsive element is interposed between the spring and the one wall.

4. A lock set according to claim 1 wherein the key actuated means includes a cylinder and rotatable cam, and the slide is provided with upwardly and downwardly facing surfaces located in the path of movement of the cam.

5. A lock set according to claim 4 wherein the slide is provided with a second upwardly facing surface below the downwardly facing surface in a position to be engaged by the cam when the slide is in its disengaged position.

6. A lock set according to claim 1 wherein the slide has a generally square body portion, an upwardly extending post at one upper corner and a downwardly projecting arm constituting the portion movable into and out of engagement with the hub, the post being provided with upwardly and downwardly facing surfaces engageable by the key actuated means.

7. A lock set according to claim 6 wherein the resilient means is a leaf spring having a portion resiliently engageable with the downwardly projecting arm.

8. A lock set according to claim 6 wherein the locking hub is formed with a radially disposed notch located, at rest, in a position to be engaged by said downwardly projecting arm.

9. A lock set according to claim 3 which includes a return spring operatively connected to the hub and wherein the heat responsive means is a washer of a material having a melting point lower than the temperature at which the return spring becomes ineffective.

* * * * *